US006036405A

United States Patent [19]

Nove et al.

[11] Patent Number: 6,036,405

[45] Date of Patent: Mar. 14, 2000

[54] RETAINING WALL SYSTEM

[76] Inventors: Fred J. Nove, 535 W. Whiting Ave., Fullerton, Calif. 92632; Gerald F. Nove, 28925 Bay Ave., Moreno, Calif. 92355

[21] Appl. No.: 09/091,011

[22] PCT Filed: Dec. 6, 1996

[86] PCT No.: PCT/US96/19453

§ 371 Date: Aug. 10, 1998

§ 102(e) Date: Aug. 10, 1998

[87] PCT Pub. No.: WO97/20997

PCT Pub. Date: Jun. 12, 1997

Related U.S. Application Data

[60] Provisional application No. 60/010,222, Dec. 8, 1995.

[51] Int. Cl.[7] ..... E02D 3/02

[52] U.S. Cl. ..... 405/284; 405/262; 405/273; 405/286; 405/287

[58] Field of Search ..... 405/273, 284, 405/285, 286, 287, 262, 272; 52/169.2, 169.3, 169.4, 604, 286, 609

[56] References Cited

U.S. PATENT DOCUMENTS

| | | | |
|---|---|---|---|
| 1,773,579 | 8/1930 | Flath | 405/273 |
| 1,787,199 | 12/1930 | Huntoon | 405/273 |
| 1,907,053 | 5/1933 | Flath | 405/273 |
| 2,092,385 | 9/1937 | Arble | 405/273 |
| 2,315,441 | 3/1943 | McDaniel | 405/273 |
| 4,244,665 | 1/1981 | Neumann | 405/286 |
| 4,384,810 | 5/1983 | Neumann | 405/284 |
| 4,512,685 | 4/1985 | Hegle | 405/284 |
| 4,664,562 | 5/1987 | Clark et al. | 405/273 |
| 4,668,129 | 5/1987 | Babcock et al. | 405/284 |
| 4,684,287 | 8/1987 | Wojciechowski | 405/286 X |
| 5,224,801 | 7/1993 | Quaney | 405/273 |

FOREIGN PATENT DOCUMENTS

| | | | |
|---|---|---|---|
| 277078 | 12/1969 | Austria | 405/273 |

*Primary Examiner*—David Bagnell
*Assistant Examiner*—Jong-Suk Lee
*Attorney, Agent, or Firm*—Fulbright & Jaworski

[57] ABSTRACT

A retaining wall system to align panels into a plurality of horizontally adjacent vertical assemblies of stacked cells to retain soil placed between the cells.

29 Claims, 6 Drawing Sheets

RETAINING WALL SYSTEM

CROSS-REFERENCE TO RELATED APPLICATION

This application claims the benefit of U.S. Provisional Application No. 60/010,222 filed Dec. 8, 1995.

FIELD OF THE INVENTION

This invention relates generally to retaining wall systems and particularly to modular retaining wall systems.

BACKGROUND OF THE INVENTION

Various methods have been used to construct walls for retaining earth, soil, sand, or other fill, which can generically be referred to as soil. Such systems are found in U.S. Pat. No. 4,572,711 to Benson et al., U.S. Pat. No. 4,655,646 to Babcock et al. and U.S. Pat. No. 4,668,129 to Babcock et al., See particularly, U.S. Pat. No. 5,030,035 to Babcock in which the retaining system is of simple construction but retains at least significant numbers of the panels it supports through openings formed through the units. In all of the foregoing structural assemblies the batter of the constructed wall is essentially limited to a predetermined selection of batter angles. It is known, however, to use, precast concrete members to form modular elements, which can be referred to as tiers, or cells, which are stackable and horizontally alignable, generally providing a progressive set back for a wall which forms a receding upward slope (i.e., batter) of the outer face of the wall. It is also desired in many forms of construction to provide not only for the retention of surfaces but to also provide plantable surfaces, for example, along the sides of freeways. The use of plantings is often a deterrent to graffiti. Notwithstanding the various modular systems that have been proposed in the past, there remains a need for a simple easily constructable modular retaining wall system in which the members can be precast or cast at the job site and which can be easily assembled and be conformable to a variety of configurations.

SUMMARY OF THE INVENTION

The present invention meets the foregoing needs by providing a system of horizontally adjacent vertical assemblies of stacked cells in which panels are supported on anchors in such a way as to facilitate the construction of battered walls wherein a wide variety of slopes and configurations of walls can be accommodated including walls which can be planted with vegetation.

More particularly, a retaining wall system under the present invention is constructed using a plurality of horizontally adjacent vertical assemblies of stacked cells. Each cell includes at least a portion of a pair of spaced anchors, each anchor having a forward top surface and a panel supported on the top surface of each pair of anchors. The anchors of each cell are aligned with corresponding anchors of a cell on which it is stacked, each anchor being formed with at least one member rearwardly of the forward top surface projecting above the forward top surface. In order to permit and accommodate a variety of slopes or batter angles, each anchor is formed with a slot into its bottom surface for receiving the projecting member of an aligned member of an adjacent cell on which it is stacked.

In a preferred embodiment of this invention, the anchors are each formed with slots that have a longitudinal extent greater than the longitudinal extent of the projecting member so that simple relative sliding of the anchors enables a batter of desired angles to be obtained, which batter can change along the vertical rise of the wall.

Also, particularly preferred is an anchor having a notch for accommodating a panel, for example a reinforced concrete panel and the projection member extends just rearwardly of the notch. A second projection member is located on the opposite, i.e., rear side of the anchor to conserve weight and materials. The anchor can be formed with a reduced thickness between the projecting members. A notch in the forward surface is substantially coterminous with the shape of the anchors and panels can be readily assembled into cells which can be arranged and stacked to form any desired assembly. Soil is then disposed between the anchors to provide a terraced surface, terraces being plantable with vegetation.

DETAILED DESCRIPTION OF THE INVENTION

Figure 1:
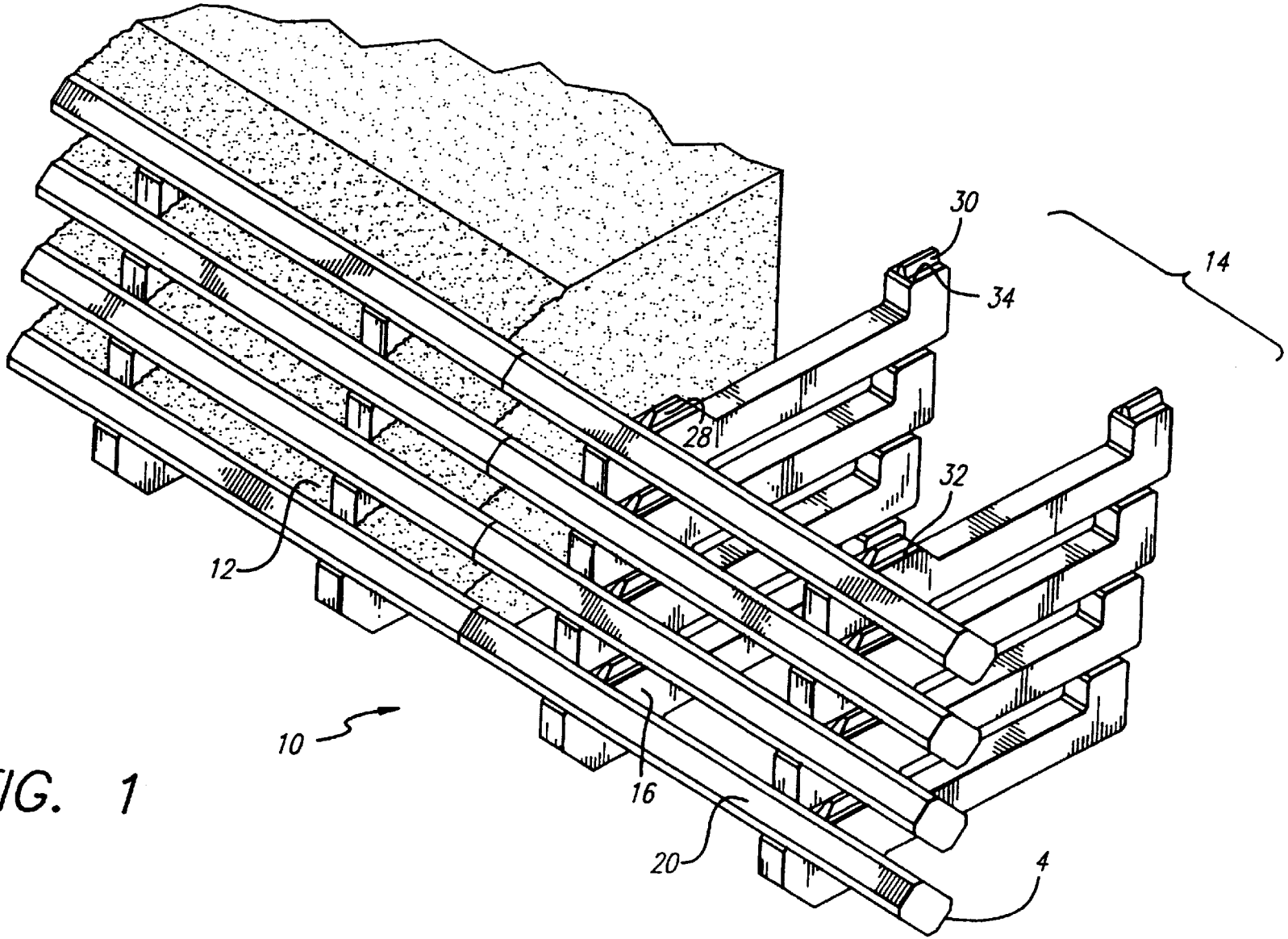
FIG. 1 is an isometric view of a retaining wall assembly in accordance with the present invention showing, in cross section, the assembly back-filled with soil.
Figure 2:
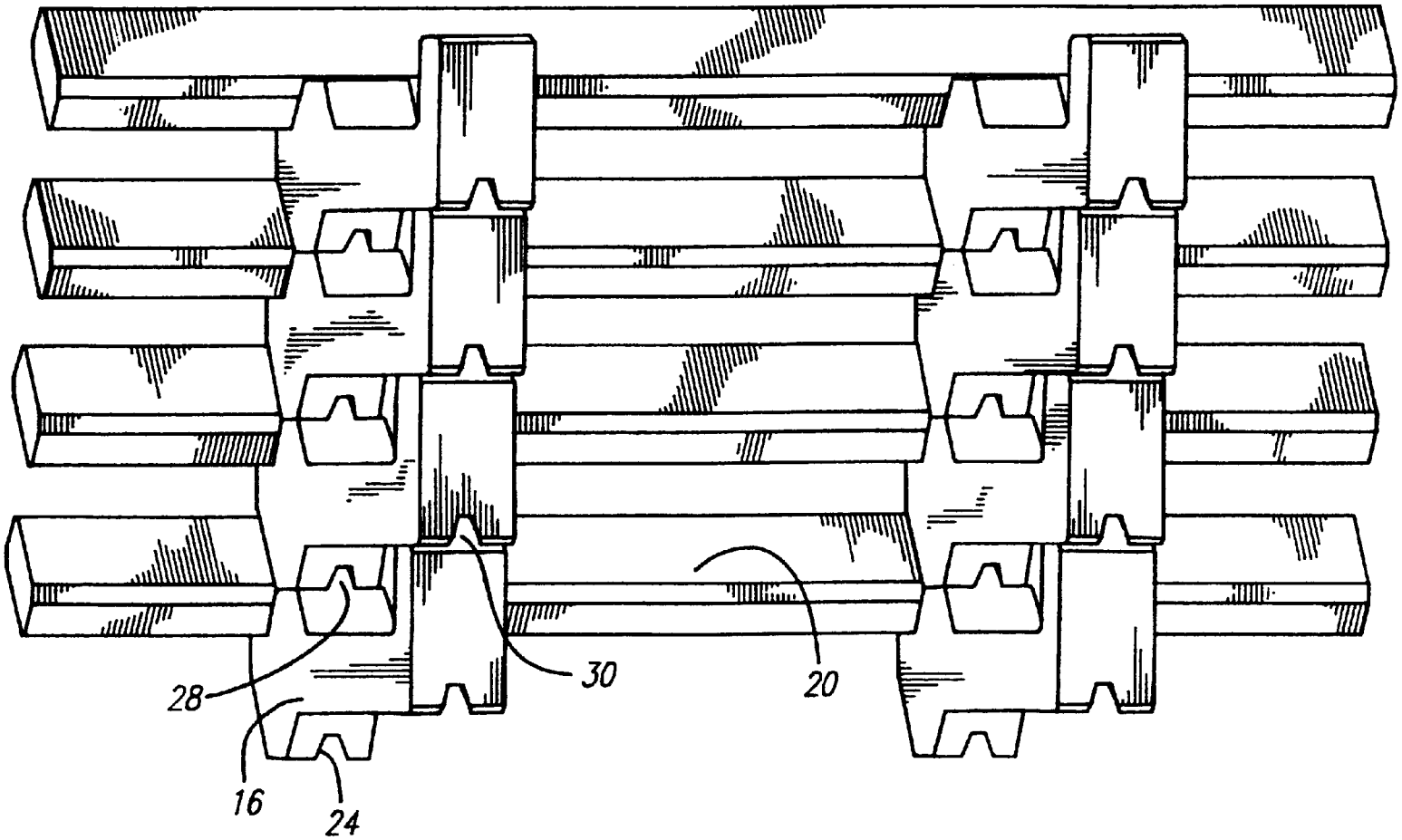
FIG. 2 is an isometric rear view of a portion of the assembly of FIG. 1.
Figure 7:
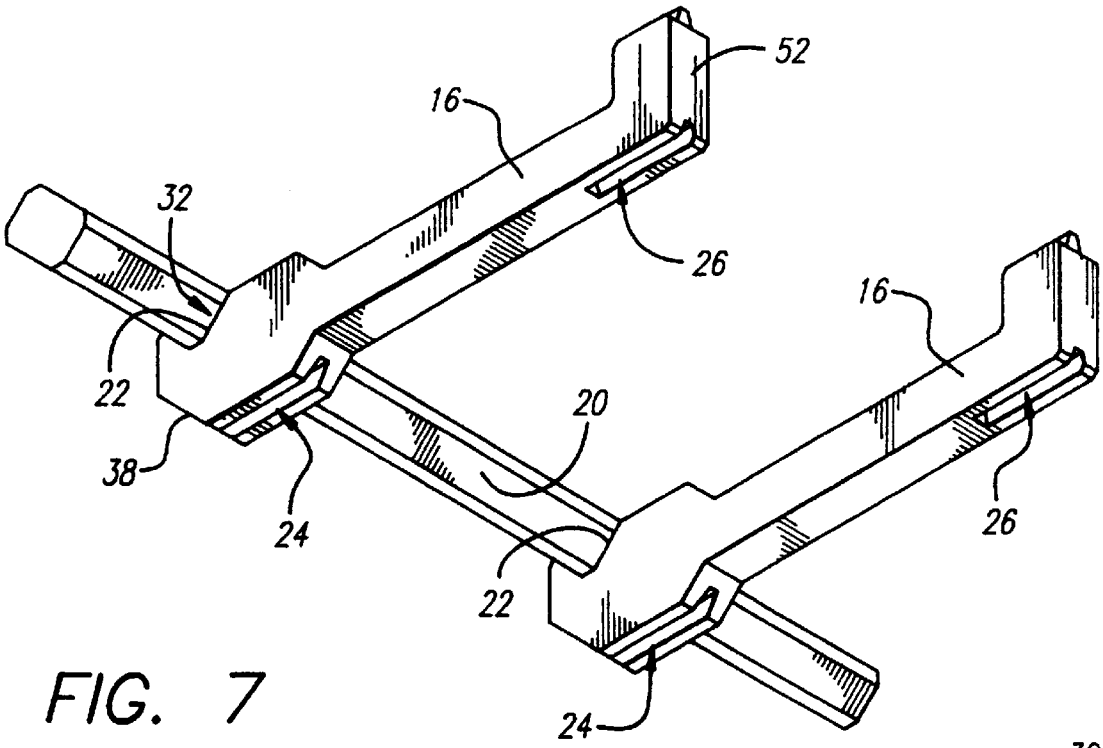
FIG. 7 is an isometric rear view of a cell in which the panel is fully supported in cantilever fashion and showing the projection slots.
Figure 8:
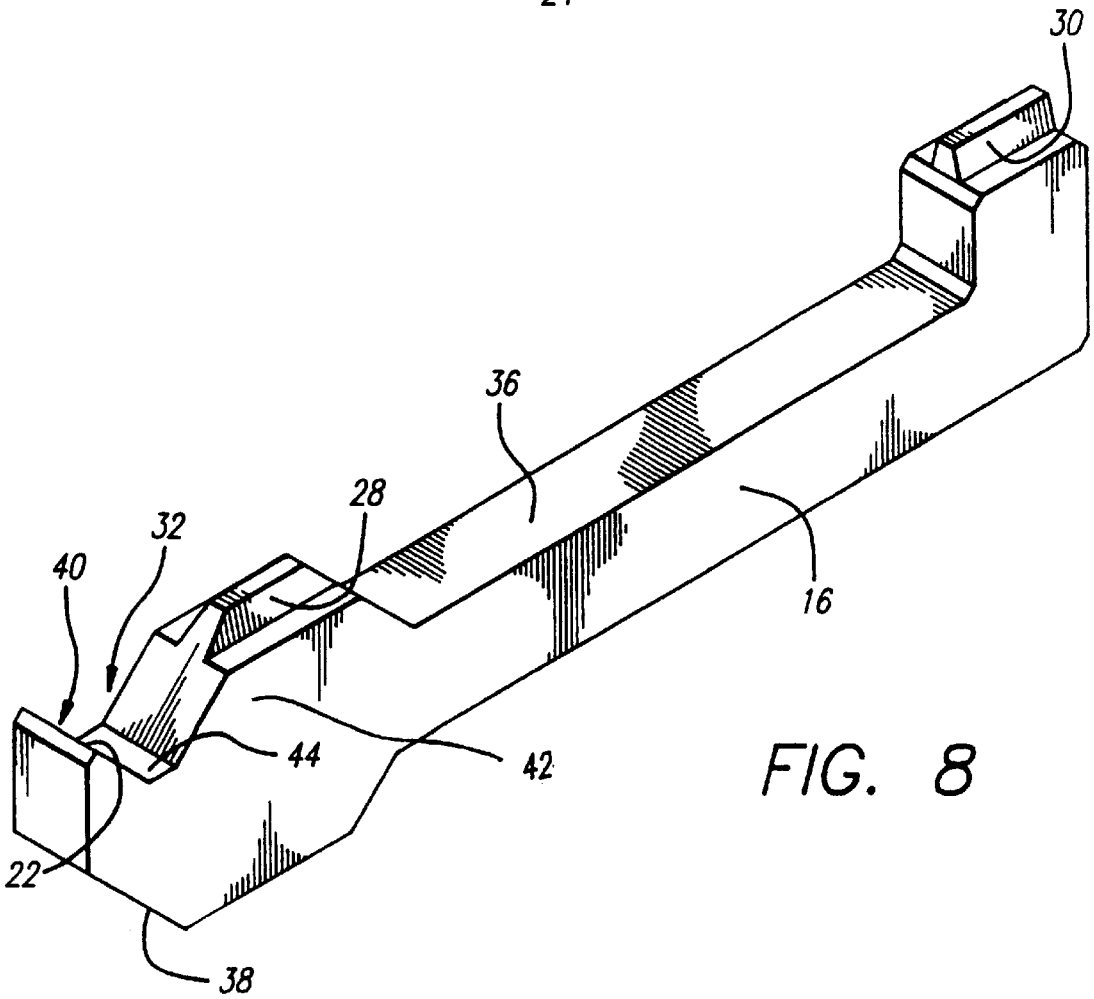
FIG. 8 is an isometric view of the anchor by itself.

Referring to FIG. 1, a retaining wall 10 is shown backfilled, but with a portion of the backfill removed for clarity of illustration. The retaining wall system is formed of precast reinforced concrete providing plantable surfaces 12 on the soil backfill within a nearly vertical retaining wall structure. The system is comprised of individual cells, as indicated at 14, stacked vertically and linked together horizontally to form walls of varying heights and lengths. Each cell is formed of at least a portion of spaced pairs of anchors 16 that are stackable one on top of the other in offset manner and, referring additionally to FIG. 8, which support reinforced concrete panels 20 on forward top surfaces 22 of each anchor. As shown additionally in FIG. 2, other than the lowermost anchors, each anchor is stacked on another anchor of like construction below it. Referring additionally to FIG. 7, each anchor 16 is formed with forward and rear slots 24 and 26 into which front and rear projections 28 and 30 (which can also be referred to as shear keys) from top surfaces 32 and 34 of the anchor 16 can be placed. The front projection 28 is adjacent the top forward surface 22 which, as shown in FIGS. 7 and 8, is notched at 32 to form a seat for receiving the generally rectangular panel 20. To save on materials and weight, the region 36 between the front and rear projections 28 and 30 is of reduced thickness. The lowermost front portion 38 of each anchor 16 is beveled at a 45° angle as are the two surfaces 40 and 42 defining the notch. A land 44 separates the two halves 40 and 42 of the notch and accommodates a beveled edge (FIG. 1) of the concrete panel 20.

Figure 3B:
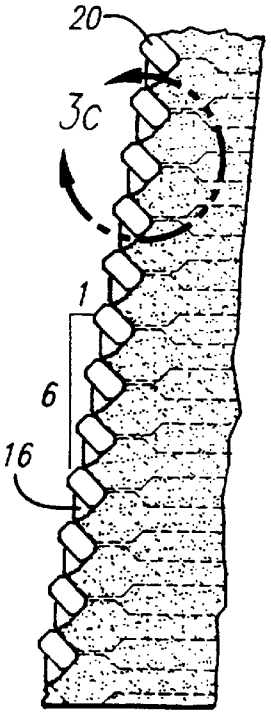
FIG. 3*b* is a schematic cross-sectional view of FIG. 3*a;*
Figure 3A:
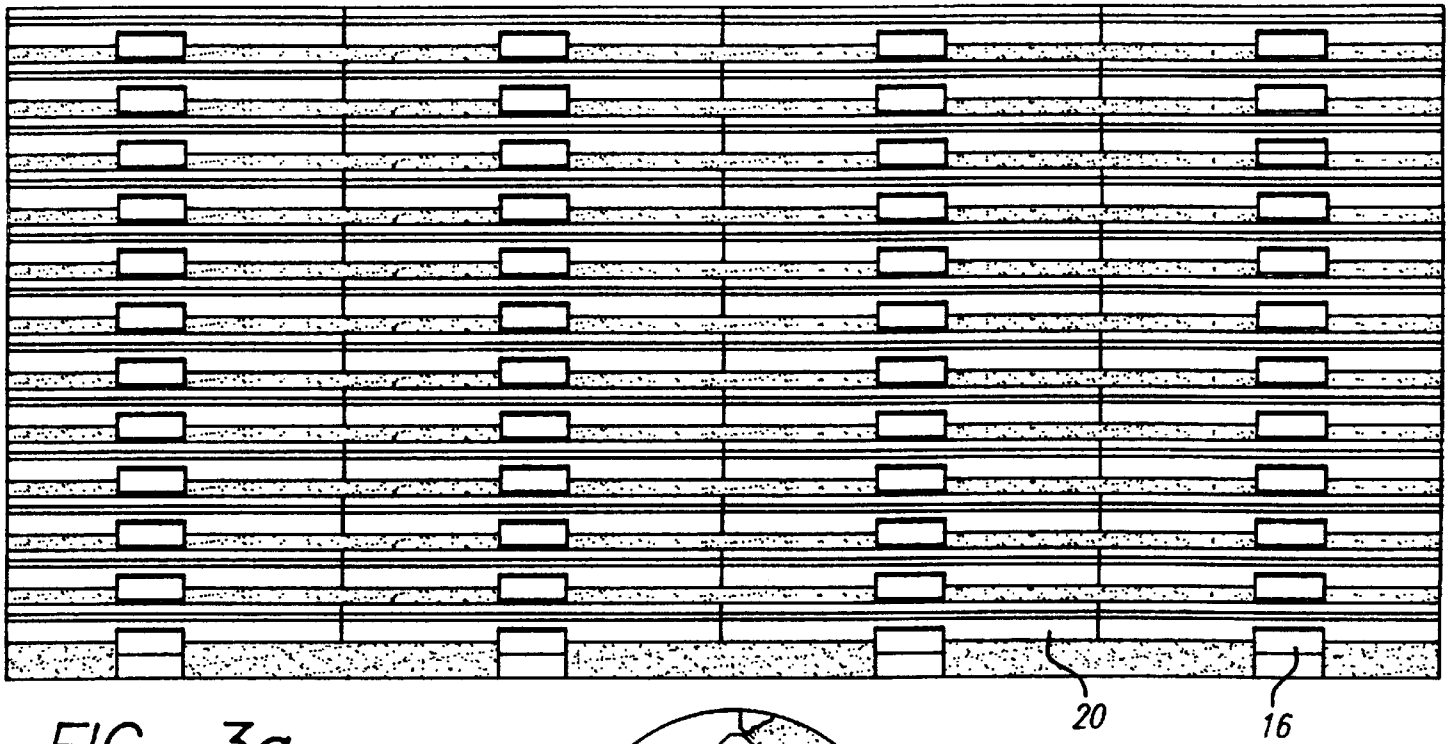
FIG. 3*a* is an elevational view of a wall constructed in accordance with the present invention in which the anchors are vertically aligned.
Figure 3C:
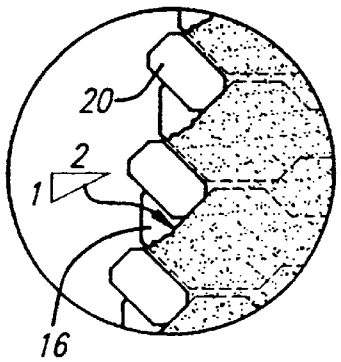
FIG. 3*c* is an enlarged detail of FIG. 3*b;*

Referring to FIGS. 3A, 3B, and 3C, in one embodiment of the invention, the anchors 16 are stacked one on top of another to form a straight stack assembly. In this case, the forward and rear projections 28 and 30 are disposed within the corresponding slots 24 and 26 of the anchor immediately above.

Figure 4B:
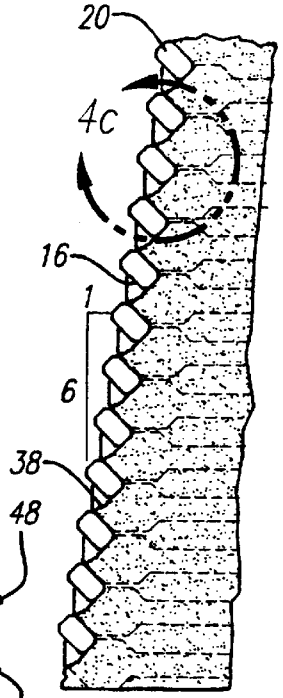
FIG. 4*b* is a schematic cross-sectional view of FIG. 3*a;*
Figure 4A:
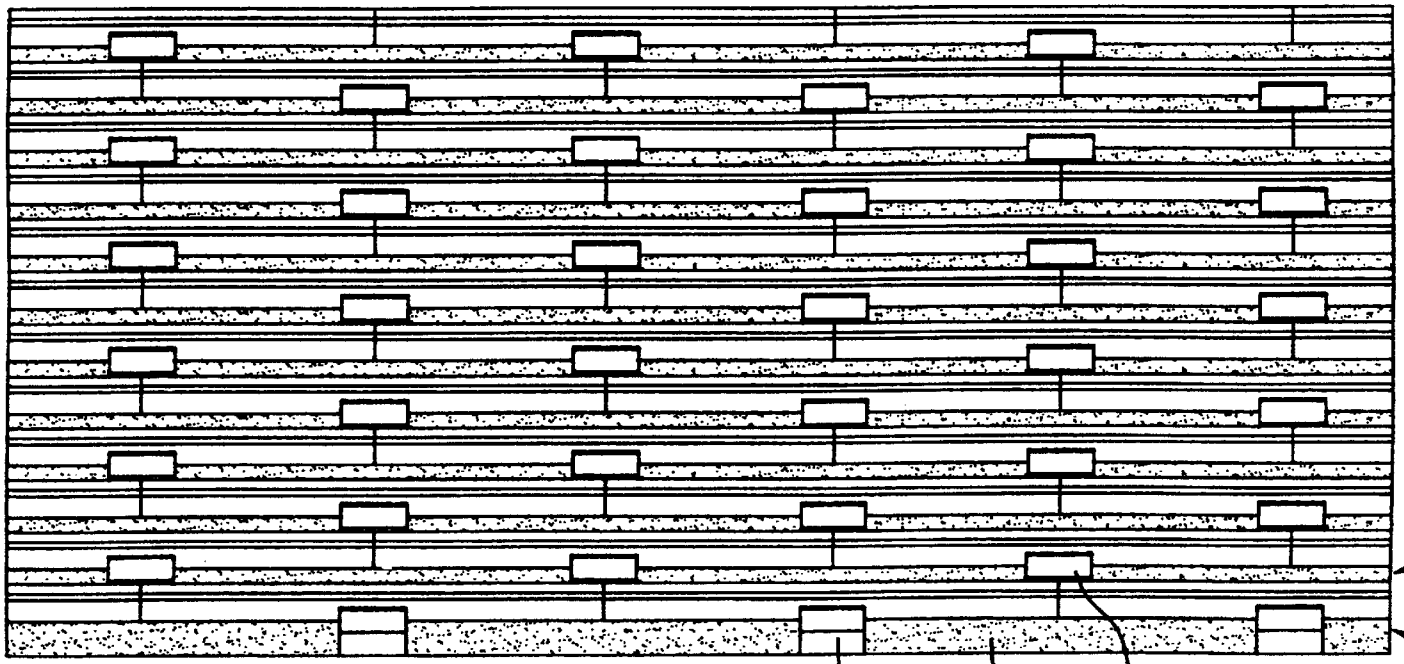
FIG. 4*a* is an elevational view of a wall constructed in accordance with the present invention in which the anchors are vertically staggered.
Figure 4C:
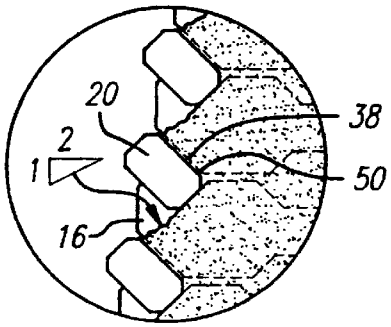
FIG. 4*c* is an enlarged detail of FIG. 3*b;*

Another embodiment of the invention is shown in FIGS. 4A, 4B, and 4C in which the anchor 16 in one horizontal group 46 is staggered from the anchors 16 on another horizontal group 48. In this case, the projections 28 and 30 are not placed in the slots 24 and 26 of the adjacent anchor 16 but, rather, the bevel 38 of each anchor 16 bears against the rear surface 50 of the panel 20.

Referring again to FIG. 7, the forward slot 24 extends to the front beveled surface 38 of the anchor and the rear surface 26 extends to the rear surface 52 of the anchor. In each case the slot 24 or 26 has a greater longitudinal extent than the longitudinal extent of the corresponding projection 28 or 30. This permits the anchors to be displaced one with respect to the other to vary the batter of the constructed wall.

Figure 5:
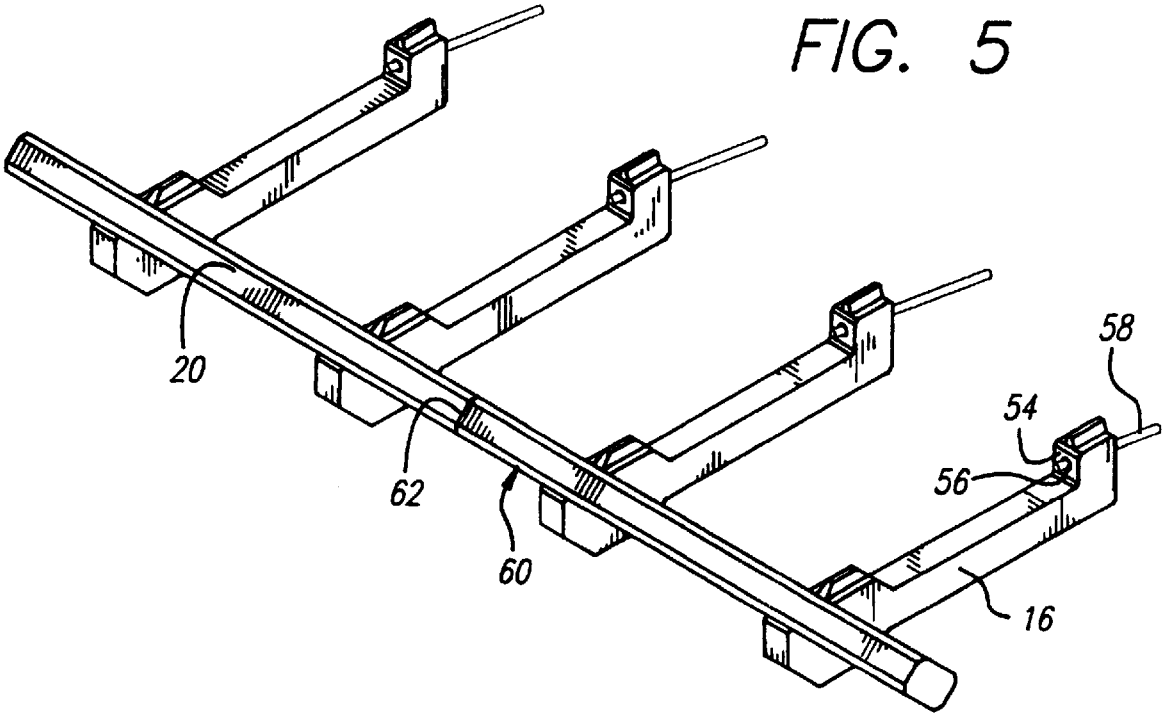
FIG. 5 is an isometric view of two adjacent cells of a panel and anchors in which the panels are cantilevered and the anchors are tied back.

Referring to FIG. 5, the decreased thickness of the center section of the anchor 16 results in a rear wall 54. A hole 56 can be drilled through the rear wall 54 through which is inserted a tie back 58, secured by any common means.

Referring to FIGS. 1 and 5, in one form of use of the invention, the panel 20 is straddled across the supporting surfaces on the anchor 16 so as to cantilever therefrom as shown by the protruding section 60 to meet at 62 with an adjacent like-disposed panel 20.

Figure 6:
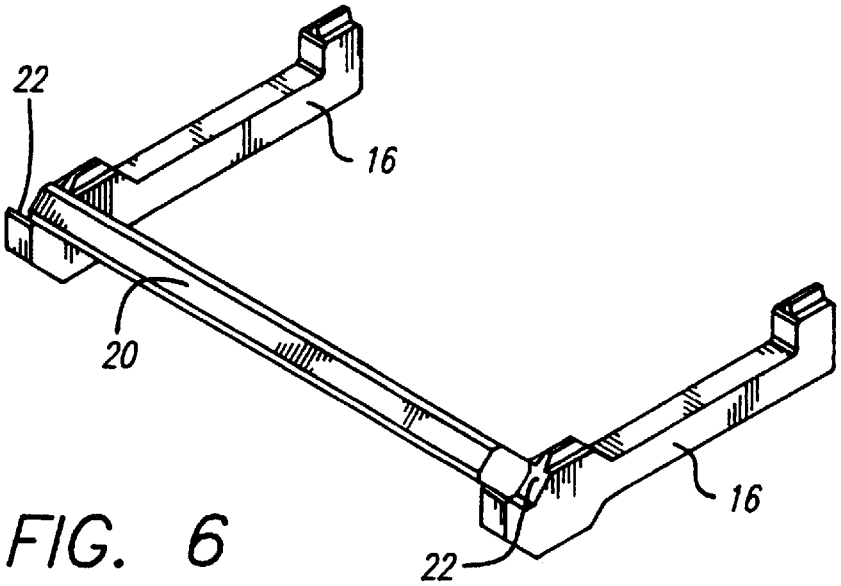
FIG. 6 is an isometric view of a cell of this invention in which the panel is partially supported at each end by the anchors.

Referring to FIG. 6 another form of utilization is shown wherein the panel 20 is secured entirely between the anchors 16. In this case, a portion only of the top forward surface 22 of each anchor 16 is utilized by one panel 20. The remaining portions of the surfaces 22 are utilized by adjacent panels (not shown).

Referring to FIGS. 3B, 3C, 4B and 4C, in a specific embodiment, the face of the constructed wall sets back approximately one foot horizontally for each six feet of vertical rise and the interior, or plantable face of the wall sets back approximately two feet horizontally for each foot of vertical rise.

There has been presented a precast reinforced concrete retaining wall system that provides plantable surfaces within a nearly vertical retaining wall structure wherein individual cells are stacked and linked together to form walls of varying heights and lengths. The lengths, widths and thicknesses of the anchors can be varied to accommodate the soil characteristics and the loads acting upon the intended wall. The projections 28 and 30, act as shear keys to lock the anchors together in order to resist seismic lateral forces. Varying degrees of batter can be obtained by sliding the upper anchor horizontally forward to steepen the batter or back to reduce to slope, the batter of the wall being determined by the horizontal setback of the anchors, allowing the anchors to be set level thereby simplifying excavation, erection and backfill operations. The cells constructed in accordance with this invention can be used in conjunction with geogrids, geosynthetics and/or other mechanical devices to provide mechanically stable embankments, with tieback rods or cables to form a facing system or can stand alone as a gravity wall. The wall systems can be made to conform to various alignments by simply mitering the panels. Utilization of the precast members of this invention eliminates lengthy cure times in the field and reduces risk exposure by shortening the length of time between excavation and backfill.

The invention has been described with respect to a specific embodiment, but persons skilled in the art will recognize that a number of additions and modifications to the invention as described, as well as alternative embodiments, may be made without departing from the spirit and scope of the invention. Accordingly, the invention should not be considered limited by the foregoing description, but rather should be limited only by the following claims.

We claim:

1. A retaining wall system, comprising:

a vertical assembly of stacked cells, each cell comprising at least portions of a pair of spaced anchors, each anchor having a front top surface, and a panel supported on the front top surfaces of said pair of anchors, the anchors of each cell being aligned with corresponding anchors of a cell on which the anchors are stacked, each anchor being formed in one piece with at least one integral member rearward of said front top surface projecting upwardly from the surface rearwardly adjacent to said forward top surface of said anchor, each anchor being formed with a slot into a bottom surface of the anchor for receiving the projecting integral member of an aligned anchor of an adjacent cell whereby to interlock as a shear key with said aligned cell anchor independent of said panel.

2. The retaining wall system of claim 1 in which said projecting member is adjacent said front top surface.

3. The retaining wall system of claim 1 in which said slot extends rearwardly of said front top surface.

4. The retaining wall system of claim 1 in which said slot extends beneath said front top surface.

5. The retaining wall system of claim 1 in which said slot extends beneath and rearwardly of said front top surface.

6. The retaining wall system of claim 1 in which said slot has a lengthwise extension greater than a lengthwise extension of said projecting member.

7. The retaining wall system of claim 1 in which each anchor is formed with at least two spaced members rearwardly of said front top surface, one member projecting above said front top surface and another member projecting above a rear top surface of said anchor.

8. The retaining wall system of claim 7 in which one of said projecting members is disposed adjacent said front top surface.

9. The retaining wall system of claim 8 in which each anchor has a portion of reduced thickness between said projecting members.

10. The retaining wall system of claim 1 in which each anchor has a lowermost region at the front end of each anchor, said lowermost region being beveled whereby to abut against a flat region of said panel.

11. The retaining wall system of claim 1 in which said panel is formed of reinforced concrete.

12. The retaining wall system of claim 1 in which said panel is an elongated member substantially rectangular in cross-section, having greater height than thickness and is supported on said pair of anchors at an acute angle to horizontal.

13. The retaining wall system of claim 1 wherein the front top surface of each anchor is defined by a notch in the front end of said anchor to receive at least a portion of said panel, said notch being substantially the shape of said received panel portion.

14. The retaining wall system of claim 13 in which said panel is formed with beveled edges.

15. The retaining wall system of claim 1 in which said retaining wall comprises a plurality of horizontally adjacent vertical assemblies of stacked cells.

16. The retaining wall system of claim 15 in which the ends of each panel are received medially on the front top surface of the anchor supports therefor, the ends of the adjacent panels meeting and sharing a medial support.

17. The retaining wall system of claim 15 in which the ends of each panel are cantilevered to extend outwardly from supporting anchors, the ends of respective adjacent panels meeting between the respective adjacent anchors.

18. A one piece anchor for use in a retaining wall system comprising:

an elongated member having a front top surface and at least one integral member rearwardly of said front top surface projecting outwardly of said anchor, and formed with a slot into a bottom surface of the anchor for receiving the projecting integral member of an aligned anchor of similar construction, whereby to interlock therewith.

19. The anchor of claim 18 in which the projecting member is adjacent said front top surface.

20. The anchor of claim 18 in which said slot extends rearwardly of said front top surface.

21. The anchor of claim 18 in which said slot extends beneath said front top surface.

22. The anchor of claim 18 in which said slot extends beneath, and rearwardly of said front top surface.

23. The anchor of claim 18 in which the retaining wall system of claim 1 in which said slot has a lengthwise extension greater than a lengthwise extension of said projecting member.

24. The anchor of claim 18 formed with at least two spaced members rearwardly of said front top surface, projecting above said front top surface.

25. The anchor of claim 24 in which one of said projecting members is disposed adjacent said front top surface and the other is on a rear top surface of said anchor.

26. The anchor of claim 25 having a reduced thickness between said projecting members.

27. The anchor of claim 18 in which the lower most region of front end of the anchor is beveled.

28. The anchor of claim 18 in which the front top surface is defined by a notch in the front end of the anchor for receiving at least a portion of a panel to be seated therein.

29. A method of retaining soil, comprising the steps of:

placing anchors in an array on a horizontal plane, each anchor being formed in one piece, having a front top surface and formed with at least one integral member rearwardly of said front top surface projecting outwardly of said anchor, and formed with a slot into a bottom surface of the anchor for receiving the projecting member of an aligned anchor of similar construction whereby to interlock as a shear key with said aligned anchor;

placing an elongated panel on said front surfaces so as to connect adjacent pairs of said anchors, the interlocking of said shear key being independent of said panel;

stacking said anchors until a retaining wall of desired height is obtained; and simultaneously with or subsequent to said step of stacking, filling spaces between said anchors with soil.

* * * * *